US009183781B2

(12) United States Patent
Jang

(10) Patent No.: US 9,183,781 B2
(45) Date of Patent: Nov. 10, 2015

(54) STAGE CIRCUIT AND BIDIRECTIONAL EMISSION CONTROL DRIVER USING THE SAME

(75) Inventor: Hwan-Soo Jang, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 482 days.

(21) Appl. No.: 13/403,834

(22) Filed: Feb. 23, 2012

(65) Prior Publication Data

US 2012/0327131 A1 Dec. 27, 2012

(30) Foreign Application Priority Data

Jun. 22, 2011 (KR) ..... 10-2011-0060441

(51) Int. Cl.
*G09G 3/32* (2006.01)

(52) U.S. Cl.
CPC ..... *G09G 3/3266* (2013.01); *G09G 2300/0861* (2013.01); *G09G 2310/0283* (2013.01); *G09G 2310/0286* (2013.01)

(58) Field of Classification Search
CPC . G09G 3/3266; G09G 3/3674; G09G 3/3677; G09G 3/3696; G09G 2310/0262; G09G 2310/0267; G09G 2310/0283; G09G 2320/064; G11C 19/00; G11C 19/182; G11C 19/184; G11C 19/28
USPC ..... 345/76–83, 87–104, 204–215
See application file for complete search history.

(56) References Cited

U.S. PATENT DOCUMENTS

2004/0217935 A1* 11/2004 Jeon et al. ..... 345/100
2007/0063933 A1* 3/2007 Chung ..... 345/76
2008/0055225 A1* 3/2008 Pak et al. ..... 345/96

(Continued)

FOREIGN PATENT DOCUMENTS

KR 10-0986862 B1 8/2010
KR 10-0986887 B1 8/2010
KR 10-1040855 B1 8/2010

OTHER PUBLICATIONS

Korean Patent Abstracts No. 10-2010-0087870 A for Publication No. KR 10-1040855 B1 (1 page).

(Continued)

*Primary Examiner* — Chanh Nguyen
*Assistant Examiner* — Navin Lingaraju
(74) *Attorney, Agent, or Firm* — Christie, Parker & Hale, LLP

(57) ABSTRACT

A stage circuit includes an output unit for outputting the voltage of a first or second power source to a first output terminal, corresponding to a voltage at a first or second node; a bidirectional driver for receiving sampling signals of previous and next stages; a first driver coupled to the bidirectional driver to control the voltages at the first and second nodes, corresponding to first and second clock signals; and a second driver coupled to the bidirectional driver to output a sampling signal corresponding to the first and second clock signals. The first driver includes a first transistor coupled between the first power source and the second node; a second transistor coupled between the second node and the second power source; a third transistor coupled between the bidirectional driver and the first node; and a first capacitor coupled between the second node and a second input terminal.

21 Claims, 9 Drawing Sheets

(56) References Cited

U.S. PATENT DOCUMENTS

| | | | | |
|---|---|---|---|---|
| 2008/0094531 | A1* | 4/2008 | Lee et al. | 349/39 |
| 2008/0219401 | A1* | 9/2008 | Tobita | 377/79 |
| 2009/0225068 | A1* | 9/2009 | Jeong et al. | 345/211 |
| 2011/0193892 | A1* | 8/2011 | Eom | 345/690 |
| 2012/0050234 | A1* | 3/2012 | Jang et al. | 345/204 |

OTHER PUBLICATIONS

Korean Patent Abstracts No. 10-2010-0087871 A for Publication No. KR 10-0986862 B1 (1 page).

Korean Patent Abstracts No. 10-2010-0093738 A for Publication No. KR 10-0986887 B1 (1 page).

* cited by examiner

STAGE CIRCUIT AND BIDIRECTIONAL EMISSION CONTROL DRIVER USING THE SAME

CROSS-REFERENCE TO RELATED APPLICATION

This application claims priority to and the benefit of Korean Patent Application No. 10-2011-0060441, filed on Jun. 22, 2011, in the Korean Intellectual Property Office, the entire content of which is incorporated herein by reference.

BACKGROUND

1. Field

Aspects of embodiments of the present invention are directed toward a stage circuit and an emission driver using the stage circuit.

2. Description of the Related Art

Recently, there have been developed various types of flat panel display devices with reduced weight and volume in comparison to that of cathode ray tube devices. The flat panel display devices include a liquid crystal display, a field emission display, a plasma display panel, an organic light emitting display, and the like.

Among these flat panel display devices, the organic light emitting display displays images using organic light emitting diodes that emit light through recombination of electrons and holes. The organic light emitting display has a fast response speed and is driven with low power consumption. In a conventional organic light emitting display, current corresponding to a data signal is supplied to an organic light emitting diode using a transistor formed in each pixel, so that the organic light emitting diode emits light.

The conventional organic light emitting display may include a data driver for supplying data signals to data lines, a scan driver for sequentially supplying a scan signal to scan lines, an emission driver for supplying an emission control signal to emission control lines, and a display unit having a plurality of pixels coupled to the data lines, the scan lines, and the emission control lines.

When a scan signal is supplied to a scan line, pixels included in the display unit are selected to receive data signals supplied from data lines. The pixels that receive the data signals generate light with a predetermined luminance corresponding to the data signals, thereby displaying a predetermined image. Here, the emission time of the pixels may be controlled by an emission control signal supplied from an emission control line. For example, the emission control signal may set the pixels to which the data signals are supplied to be in a non-emission state while being supplied to overlap with the scan signal supplied to one or two scan lines.

To this end, the emission driver may include stages (stage circuits) respectively coupled to the emission control lines.

SUMMARY

Aspects of embodiments of the present invention are directed toward a stage circuit and an emission driver using the stage circuit. Further aspects of embodiments of the present invention are directed toward a stage circuit and an emission driver using the stage circuit that are capable of ensuring the stability of outputs and freely adjusting the width of an emission control signal.

According to an exemplary embodiment of the present invention, a stage circuit for a current stage is provided. The stage circuit includes: an output unit for outputting a voltage of a first or second power source to a first output terminal, corresponding to a voltage at a first or second node; a bidirectional driver for receiving sampling signals of previous and next stages; a first driver coupled to the bidirectional driver and configured to control the voltages at the first and second nodes, corresponding to first and second clock signals; and a second driver coupled to the bidirectional driver and configured to output a sampling signal of the current stage corresponding to the first and second clock signals. The first driver includes: a first transistor coupled between the first power source and the second node, and including a gate electrode coupled to the first node; a second transistor coupled between the second node and the second power source, and including a gate electrode coupled to a first input terminal; a third transistor coupled between the bidirectional driver and the first node, and including a gate electrode coupled to the first input terminal; and a first capacitor coupled between the second node and a second input terminal.

The first driver may further include a second capacitor coupled between the first node and the first power source.

The first input terminal may be configured to receive the first clock signal and the second input terminal may be configured to receive the second clock signal.

The first and second clock signals may be configured to be supplied during different horizontal periods from each other.

The first power source may be set to have a higher voltage than the second power source.

The output unit may include: a fourth transistor coupled between the first power source and the first output terminal, and including a gate electrode coupled to the first node; a fifth transistor coupled between the first output terminal and the second power source, and including a gate electrode coupled to the second node; and a third capacitor coupled between the first power source and the first output terminal.

The second driver may include: a sixth transistor coupled between the first power source and a second output terminal, and including a gate electrode coupled to the first output terminal; a seventh transistor coupled between the second output terminal and the second input terminal, and including a gate electrode coupled to a third node; an eighth transistor coupled between the third node and the bidirectional driver, and including a gate electrode coupled to the first input terminal; and a fourth capacitor coupled between the third node and the second output terminal.

The bidirectional driver may include: a ninth transistor coupled between the previous stage and a fourth node that is a common terminal of the first and second drivers, and including a gate electrode configured to receive a first control signal; and a tenth transistor coupled between the next stage and the fourth node, and including a gate electrode configured to receive a second control signal.

The first and second control signals may be configured to be supplied without overlapping each other.

The stage circuit may further include an eleventh transistor coupled between the first node and the second power source, and including a gate electrode configured to receive a reset signal.

The reset signal may be configured to be supplied at least once when power is turned on or off.

The stage circuit may further include a twelfth transistor coupled between the first capacitor and the second input terminal, and including a gate electrode coupled to the second node.

The first transistor may have a lower resistance than the second transistor.

An emission driver for supplying an emission control signal to emission control lines to control emission of pixels may include the stage circuit coupled to one of the emission control lines.

According to another exemplary embodiment of the present invention, an emission driver for supplying an emission control signal to emission control lines via corresponding stages to control emission of pixels is provided. The emission driver includes a stage circuit for each of the stages and coupled to a respective one of the emission control lines. The stage circuit for a current one of the stages includes: an output unit for outputting a voltage of a first or second power source to a first output terminal coupled to the respective one of the emission control lines, corresponding to a voltage at a first or second node; a bidirectional driver for receiving sampling signals of previous and next ones of the stages; a first driver coupled to the bidirectional driver and configured to control the voltages at the first and second nodes, corresponding to first and second clock signals; and a second driver coupled to the bidirectional driver and configured to output a sampling signal of the current one of the stages corresponding to the first and second clock signals. The first driver includes: a first transistor coupled between the first power source and the second node, and including a gate electrode coupled to the first node; a second transistor coupled between the second node and the second power source, and including a gate electrode coupled to a first input terminal; a third transistor coupled between the bidirectional driver and the first node, and including a gate electrode coupled to the first input terminal; and a first capacitor coupled between the second node and a second input terminal.

The first and second input terminals of a k-th (k is an odd number) one of the stages may be configured to receive the first and second clock signals, respectively. The first and second input terminals of a (k+1)-th one of the stages may be configured to receive the second and first clock signals, respectively.

The output unit may include: a fourth transistor coupled between the first power source and the first output terminal, and including a gate electrode coupled to the first node; a fifth transistor coupled between the first output terminal and the second power source, and including a gate electrode coupled to the second node; and a second capacitor coupled between the first power source and the first output terminal.

The second driver includes: a sixth transistor coupled between the first power source and a second output terminal, and including a gate electrode coupled to the first output terminal; a seventh transistor coupled between the second output terminal and the second input terminal, and including a gate electrode coupled to a third node; an eighth transistor coupled between the third node and the bidirectional driver, and including a gate electrode coupled to the first input terminal; and a third capacitor coupled between the third node and the second output terminal.

The emission driver may further include an eleventh transistor coupled between the first node and the second power source, and including a gate electrode configured to receive a reset signal.

The reset signal may be configured to be supplied at least once when power is turned on or off.

The emission driver may further include a twelfth transistor coupled between the first capacitor and the second input terminal, and include a gate electrode coupled to the second node.

According to aspects of embodiments of the present invention, since the stage circuit and the emission driver using the stage circuit are driven corresponding to two clock signals, the configuration of the circuit is simplified, and accordingly, it is possible to improve the reliability of the circuit. According to further aspects, whenever the clock signal is supplied, the voltage of a gate electrode of a transistor that outputs a low signal is decreased, and accordingly, it is possible to stably output the low signal.

BRIEF DESCRIPTION OF THE DRAWINGS

The accompanying drawings, together with the specification, illustrate exemplary embodiments of the present invention, and, together with the description, serve to explain aspects and principles of the present invention.

DETAILED DESCRIPTION

Figure 1:
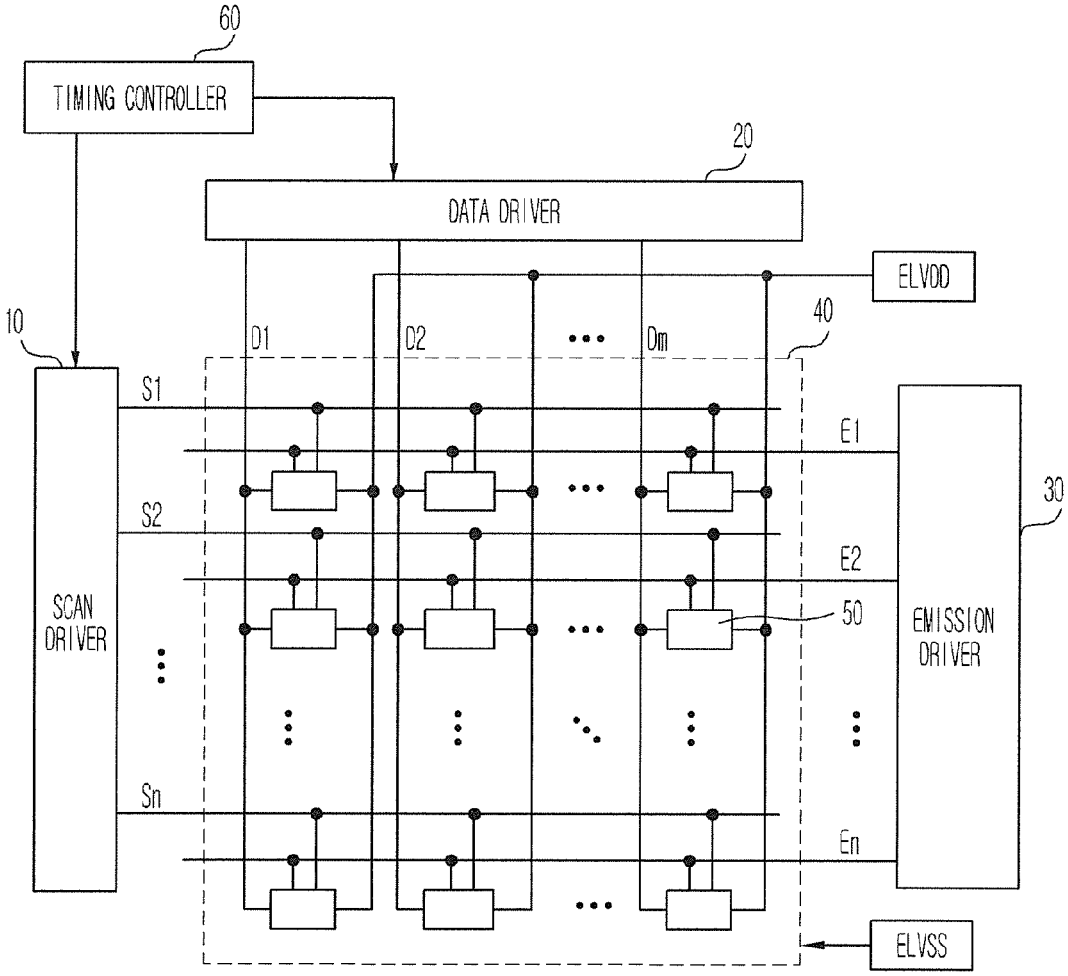
FIG. 1 is a block diagram showing an organic light emitting display according to an embodiment of the present invention.

Hereinafter, certain exemplary embodiments according to the present invention will be described with reference to the accompanying drawings. Here, when a first element is described as being coupled to a second element, the first element may be not only directly coupled (for example, connected) to the second element, but may also be indirectly coupled (for example, electrically connected) to the second element via one or more third elements. Further, some of the elements that are not essential to the complete understanding of the invention are omitted for clarity. In addition, like reference numerals refer to like elements throughout.

The stages (stage circuits) of an emission driver in an organic light emitting display may receive four or more clock signals, and output a high or low voltage to an output line. However, since the stages included in such an emission driver are driven by the four or more clock signals, the stages may include a large number of transistors. Therefore, manufacturing cost may be increased, and it may be difficult to ensure the reliability of driving. For example, when the emission driver is configured using PMOS transistors, the output of a low signal may be unstable.

More specifically, when a low signal is supplied to an emission control line, a gate electrode of a transistor that outputs the low signal should maintain a voltage lower than the low signal. However, the voltage of the gate electrode of the transistor may be increased by leakage current or the like, and therefore, the output of the low signal may become unstable.

FIG. 1 is a block diagram showing an organic light emitting display according to an embodiment of the present invention.

Referring to FIG. 1, the organic light emitting display includes a display unit 40 having pixels 50 positioned at crossing regions of scan lines S1 to Sn, data lines D1 to Dm, and emission control lines E1 to En; a scan driver 10 for driving the scan lines S1 to Sn; a data driver 20 for driving the data lines D1 to Dm; an emission driver 30 for driving the emission control lines E1 to En; and a timing controller 60 for controlling the scan, data, and emission drivers 10, 20, and 30.

The scan driver 10 sequentially supplies a scan signal to the scan lines S1 to Sn. As the scan signal is supplied to each of the scan lines S1 to Sn, pixels 50 are selected for each horizontal line.

The data driver 20 supplies data signals to the data lines D1 to Dm in synchronization with the scan signal. The data signals supplied to the data lines D1 to Dm are supplied to the pixels 50 selected by the scan signal.

The emission driver 30 sequentially supplies an emission control signal to the emission control lines E1 to En. Here, the emission driver 30 supplies the emission control signal so that the pixels 50 are set to be in a non-emission state during a period in which voltages corresponding to the data signals are charged. To this end, the emission control signal supplied to an i-th (i is a natural number) emission control line Ei is overlapped with the scan signal supplied to an i-th scan line Si. Meanwhile, the width of the emission control signal may be freely set corresponding to a structure of the pixel 50, a luminance to be implemented, or the like.

Figure 2:
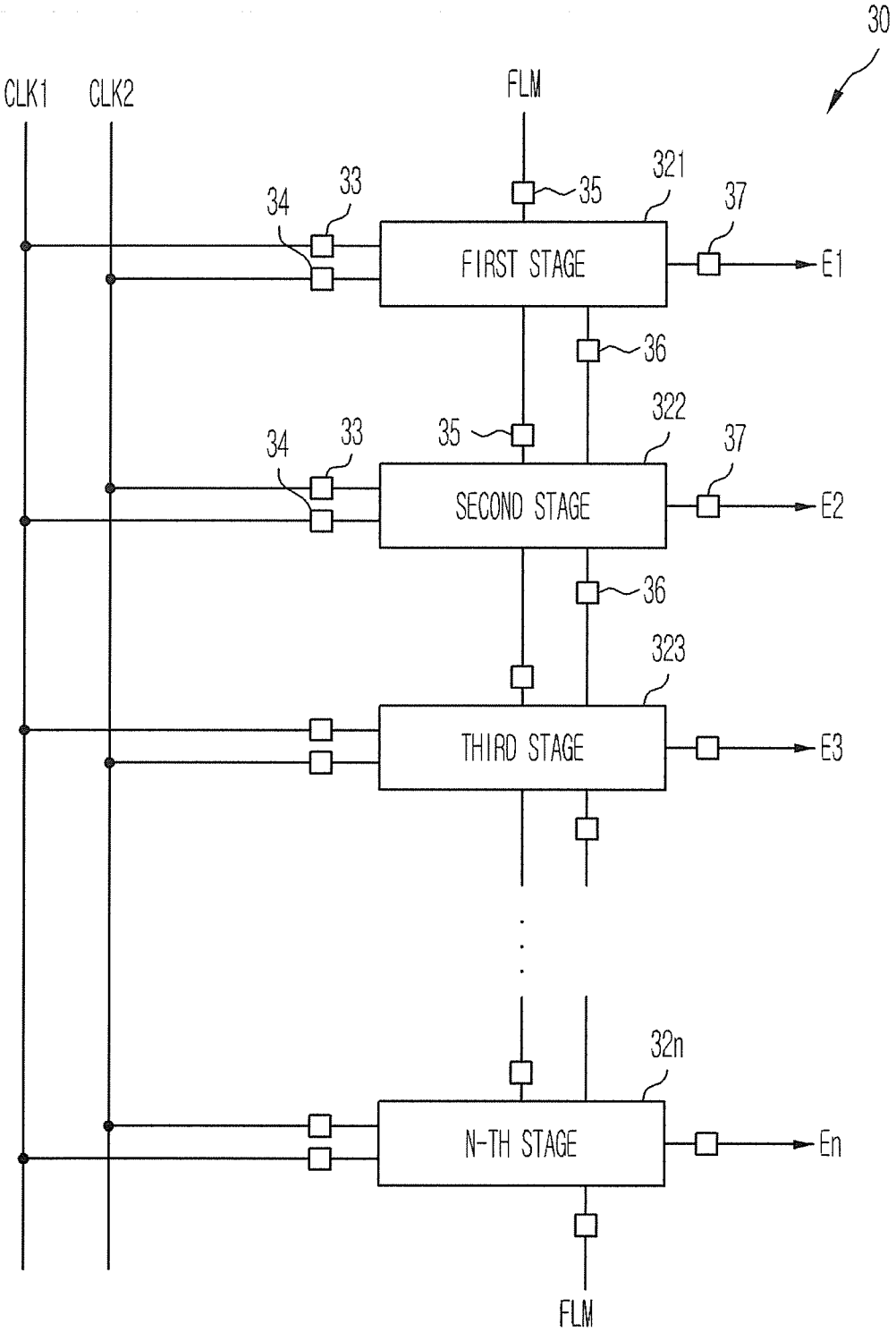
FIG. 2 is block diagram schematically showing stages (stage circuits) in an emission driver shown in FIG. 1.

FIG. 2 is block diagram schematically showing stages (stage circuits) in the emission driver 30 shown in FIG. 1.

Referring to FIG. 2, the emission driver 30 includes n stages 321 to 32*n* (namely, a first stage 321, a second stage 322, . . . , an n-th stage 32*n*) for supplying an emission control signal to the n emission control lines E1 to En. The stages 321 to 32*n* are coupled to the emission control lines E1 to En, respectively. The stages 321 to 32*n* are driven by two clock signals, namely, a first clock signal CLK1 and a second clock signal CLK2. Each of the stages 321 to 32*n* includes a first input terminal 33, a second input terminal 34, a third input terminal 35, a fourth input terminal 36, and a first output terminal 37.

The first input terminal 33 included in a k-th (k is an odd number) stage 32*k* receives the first clock signal CLK1, and the second input terminal 34 included in the k-th stage 32*k* receives the second clock signal CLK2. In contrast, the first input terminal 33 included in a (k+1)-th stage 32*k*+1 (that is, an even stage) receives the second clock signal CLK2, and the second input terminal 34 included in the (k+1)-th stage 32*k*+1 receives the first clock signal CLK1. The third input terminal 35 included in each of the stages 321 to 32*n* receives a sampling signal of the previous stage (the first stage 321 receives a start signal FLM), and the fourth input terminal 36 included in each of the stages 321 to 32*n* receives a sampling signal of the next stage (the n-th stage 32*n* receives the start signal FLM). The first output terminal 37 included in each of the stages 321 to 32*n* is coupled to one of the emission control lines E1 to En, respectively, and outputs an emission control signal to the one of the emission control lines E1 to En.

The stages 321 to 32*n* are configured as the same circuit, and output an emission control signal of which a width is changed corresponding to the start signal FLM.

Figure 3:
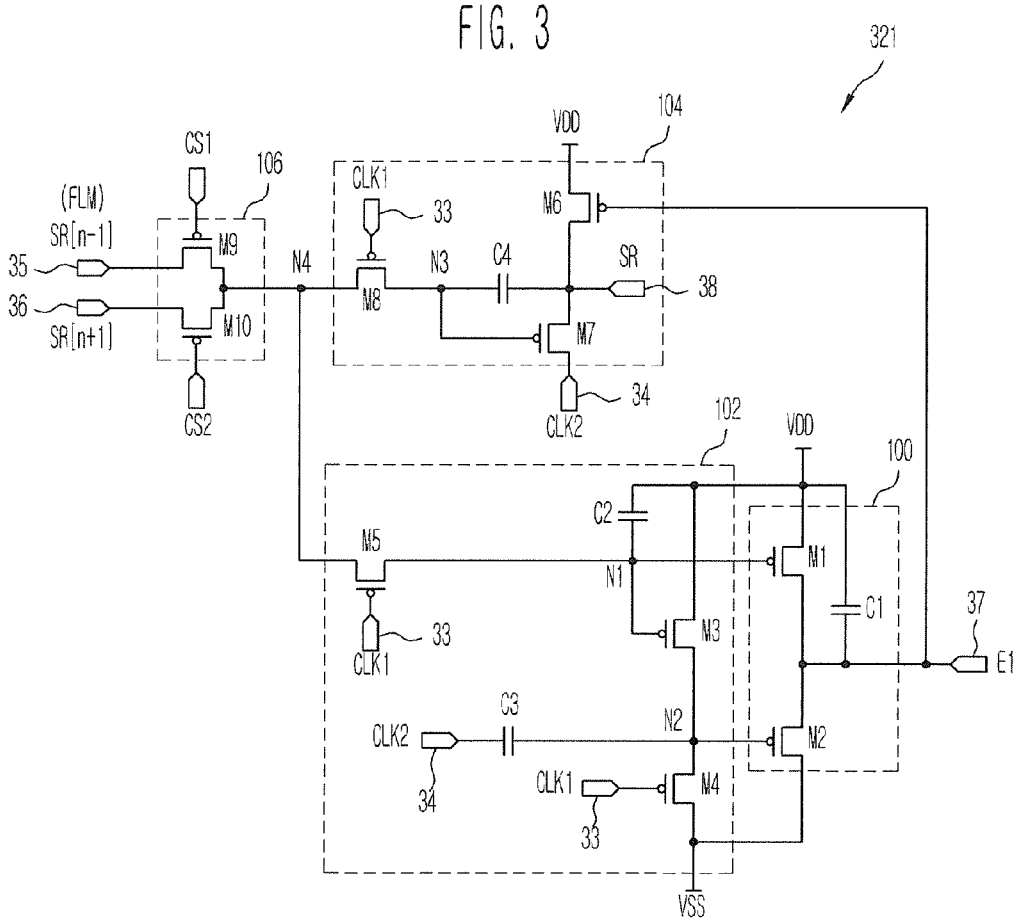
FIG. 3 is a circuit diagram showing a first embodiment of the stage shown in FIG. 2.

FIG. 3 is a circuit diagram showing a first embodiment of the stage shown in FIG. 2. For convenience of illustration, the first stage 321 is shown in FIG. 3.

Referring to FIG. 3, the first stage 321 includes an output unit 100, a first driver 102, a second driver 104, and a bidirectional driver 106. The output unit 100 outputs a voltage of a first power source VDD or a voltage of a second power source VSS set to a voltage lower than the voltage of the first power source VDD to the first output terminal 37, corresponding to a voltage applied to a first node N1 and a second node N2. To this end, the output unit 100 includes a first transistor M1, a second transistor M2, and a first capacitor C1.

The first transistor M1 is coupled between the first power source VDD and the first output terminal 37. A gate electrode of the first transistor M1 is coupled to the first node N1. The first transistor M1 supplies the voltage of the first power source VDD to the first output terminal 37, corresponding to a voltage at the first node N1. The voltage of the first power source VDD, supplied to the first output terminal 37, is supplied as an emission control signal to the emission control line E1.

The second transistor M2 is coupled between the first output terminal 37 and the second power source VSS. A gate electrode of the second transistor M2 is coupled to the second node N2. The second transistor M2 supplies the voltage of the second power source VSS to the first output terminal 37, corresponding to a voltage at the second node N2.

The first capacitor C1 is coupled between the first power source VDD and the first output terminal 37. The first capacitor C1 stabilizes the voltage of the first output terminal 37 based on the voltage of the first power source VDD.

The first driver 102 controls voltages at the first and second nodes N1 and N2, corresponding to the first clock signal CLK1, the second clock signal CLK2, and the voltage supplied from the bidirectional driver 106. To this end, the first driver 102 includes a third transistor M3, a fourth transistor M4, a fifth transistor M5, a second capacitor C2, and a third capacitor C3.

The third transistor M3 is coupled between the first power source VDD and the second node N2. A gate electrode of the third transistor M3 is coupled to the first node N1. The third transistor M3 supplies the voltage of the first power source VDD to the second node N2, corresponding to the voltage at the first node N1.

The fourth transistor M4 is coupled between the second node N2 and the second power source VSS. A gate electrode of the fourth transistor M4 is coupled to the first input terminal 33. The fourth transistor M4 is turned on or off, corresponding to the first clock signal CLK1 supplied to the first input terminal 33.

The fifth transistor M5 is coupled between the bidirectional driver 106 and the first node N1. A gate electrode of the fifth transistor M5 is coupled to the first input terminal 33. The fifth transistor M5 is turned on or off, corresponding to the first clock signal CLK1 supplied to the first input terminal 33.

The second capacitor C2 is coupled between the first node N1 and the first power source VDD. The second capacitor C2 stores the voltage applied to the first node N1.

The third capacitor C3 is coupled between the second node N2 and the second input terminal 34. The third capacitor C3 controls the voltage at the second node N2, corresponding to the second clock signal CLK2 supplied to the second input terminal 34. The detailed operating process of the third capacitor C3 will be described later.

The second driver 104 outputs a sampling signal SR to a second output terminal 38, corresponding to the first clock signal CLK1, the second clock signal CLK2, and the voltage supplied from the bidirectional driver 106. The second output terminal 38 included in each of the stages 321 to 32*n*−1 is coupled to one of the third input terminals 35 of respective next ones of the stages 322 to 32*n*. In addition, the second output terminal 38 included in each of the stages 322 to 32*n* is coupled to one of the fourth input terminals 36 of respective previous ones of the stages 321 to 32*n*−1. To this end, the second driver 104 includes a sixth transistor M6, a seventh transistor M7, an eighth transistor M8, and a fourth capacitor C4.

The sixth transistor M6 is coupled between the first power source VDD and the second output terminal 38. A gate electrode of the sixth transistor M6 is coupled to the first output terminal 37. The sixth transistor M6 is turned on or off, corresponding to the voltage applied to the first output terminal 37. Practically, the sixth transistor M6 is turned off during a period in which an emission control signal is supplied to the first output terminal 37. The sixth transistor M6 is turned on during a period in which the emission control signal is not supplied to the first output terminal 37.

The seventh transistor M7 is coupled between the second output terminal 38 and the second input terminal 34. A gate electrode of the seventh transistor M7 is coupled to a third node N3. The seventh transistor M7 is turned on or off, corresponding to the voltage supplied to the third node N3.

The eighth transistor M8 is coupled between the bidirectional driver 106 and the third node N3. A gate electrode of the eighth transistor M8 is coupled to the first input terminal 33. The eighth transistor M8 is turned on or off, corresponding to the first clock signal CLK1 supplied to the first input terminal 33.

The bidirectional driver 106 is coupled between the third input terminal 35 and the fourth input terminal 36. The bidirectional driver 106 supplies a sampling signal SRn−1 (or start signal FLM in the first stage 321) of the previous stage, inputted to the third input terminal 35, or a sampling signal SRn+1 of the next stage (inputted to the fourth input terminal 36) to the first and second drivers 102 and 104, corresponding to a first control signal CS1 or a second control signal CS2. To this end, the bidirectional driver 106 includes a ninth transistor M9 and a tenth transistor M10.

The ninth transistor M9 is coupled between the third input terminal 35 and a fourth node N4. A gate electrode of the ninth transistor M9 receives the first control signal CS1. When the first control signal CS1 is inputted, the ninth transistor M9 is turned on so that the fourth node N4 is electrically coupled to the third input terminal 35.

The tenth transistor M10 is coupled between the fourth input terminal 36 and the fourth node N4. A gate electrode of the tenth transistor M10 receives the second control signal CS2. When the second control signal CS2 is inputted, the tenth transistor M10 is turned on so that the fourth node N4 is electrically coupled to the fourth input terminal 36.

Meanwhile, the first and second control signals CS1 and CS2 are supplied from the timing controller 60 (or a separate driver) so as not to overlap with each other. When the first control signal CS1 is supplied, the stages 321 to 32*n* sequentially supply an emission control signal in a first direction (that is, a forward direction, from the first stage 321 to the n-th stage 32*n*). When the second control signal CS2 is supplied, the stages 321 to 32*n* sequentially supply the emission control signal in a second direction (that is, a backward direction, from the n-th stage 32*n* to the first stage 321).

Figure 4:
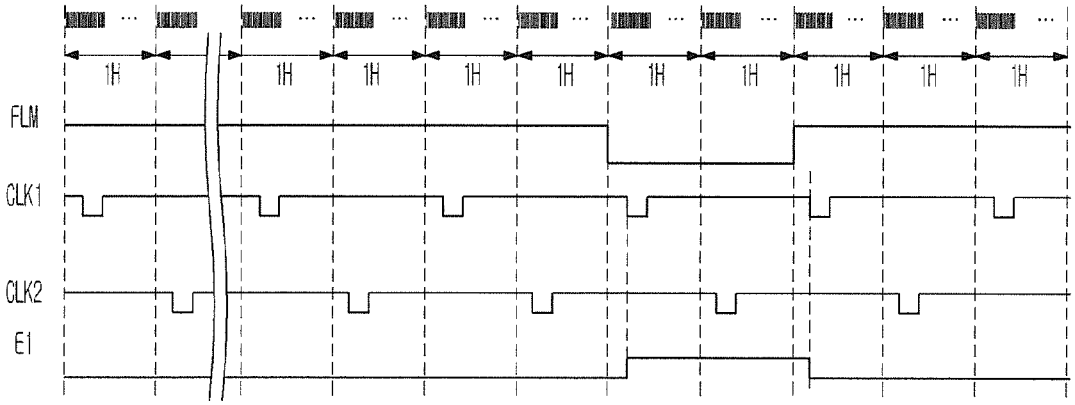
FIG. 4 is a waveform diagram illustrating a driving method of the stage circuit shown in FIG. 3.

FIG. 4 is a waveform diagram illustrating a driving method of the stage circuit shown in FIG. 3. For convenience of illustration, a case where the start signal FLM is supplied to the first stage 321 is shown in FIG. 4.

Referring to FIG. 4, the first and second clock signals CLK1 and CLK2 have the same period, and are supplied during different horizontal periods from each other. The start signal FLM is supplied with a width (for example, a predetermined width), i.e., so that the start signal FLM is overlapped with the first clock signal CLK1 at least once or more.

The operating process of the stage 321 in FIG. 3 will be described in detail. First, the ninth transistor M9 is turned on by the first control signal CS1. After the ninth transistor M9 is turned on, the start signal FLM (low signal) is supplied to the third input terminal 35.

The start signal FLM supplied to the third input terminal 35 is supplied to the fourth node N4 via the ninth transistor M9. Then, the first clock signal CLK1 is supplied to the first input terminal 33. When the first clock signal CLK1 is supplied, the fourth, fifth, and eighth transistors M4, M5, and M8 are turned on.

When the fifth transistor M5 is turned on, the start signal FLM is supplied to the first node N1. When the start signal FLM is supplied to the first node N1, the first and third transistors M1 and M3 are turned on. When the first transistor M1 is turned on, the voltage of the first power source VDD, i.e., the emission control signal, is supplied to the emission control line E1 via the first output terminal 37. In this instance, the voltage at the first node N1 is charged in the second capacitor C2.

When the third transistor M3 is turned on, the second node N2 is electrically coupled to the first power source VDD. When the fourth transistor M4 is turned on by the first clock signal CLK1, the second node N2 is electrically coupled to the second power source VSS. In this case, the first power source VDD, the third transistor M3, the fourth transistor M4, and the second power source VSS are electrically coupled to one another.

Here, it is assumed that the third and fourth transistors M3 and M4 are set to have the same resistance. Then, a voltage corresponding to approximately half of the voltage of the first power source VDD is applied to the second node N2, and accordingly, the second transistor M2 is set to be in a turned-off state. Additionally, in the present embodiment of FIG. 3, the third transistor M3 may be formed to have a resistance (e.g., channel-ratio control, parallel connection of a plurality of transistors, or the like) lower than that of the fourth transistor M4. In this case, the voltage applied to the second node N2 is increased so that the second transistor M2 can be more stably turned off.

When the eighth transistor M8 is turned on, the start signal FLM is supplied to the third node N3. When the start signal FLM is supplied to the third node N3, the seventh transistor M7 is turned on. When the seventh transistor M7 is turned on, the second input terminal 34 is electrically coupled to the second output terminal 38. In this instance, the first clock signal CLK1 is low, so the second clock signal CLK2 that is supplied to the second output terminal 38 is high, and hence a high voltage is supplied to the second output terminal 38. When the seventh transistor M7 is turned on, a voltage corresponding to the turned-on of the seventh transistor M7 is charged in the fourth capacitor C4.

Then, the supply of the first clock signal CLK1 is stopped so that the fourth, fifth and eighth transistors M4, M5 and M8 are turned off. In this instance, the first and third transistors M1 and M3 maintain a turned-on state, corresponding to the voltage charged in the second capacitor C2. When the first transistor M1 is turned on, the voltage of the first power source VDD is supplied to the first output terminal 37. When the third transistor M3 is turned on, the voltage of the first power source VDD is supplied to the second node N2 so that the second transistor M2 is set to be in a turned-off state. Although the eighth transistor M8 is turned off, the seventh transistor M7 maintains a turned-on state, corresponding to the voltage charged in the fourth capacitor C4.

Then, the second clock signal CLK2 (i.e., a low signal) is supplied to the second input terminal 34. When the second clock signal CLK2 is supplied to the second input terminal 34, the second clock signal CLK2 is supplied to the second output terminal 38 via the seventh transistor M7. The second clock signal CLK2 supplied to the second output terminal 38 is supplied as a sampling signal SR to the next and previous stages.

The second clock signal CLK2 supplied to the second input terminal 34 is supplied to a first terminal of the third capacitor C3. In this instance, the second node N2 is electrically coupled to the first power source VDD, and hence the voltage at the second node N2 maintains the voltage of the first power source VDD regardless of the second clock signal CLK2.

Then, the supply of the start signal FLM is stopped, and the first clock signal CLK1 is supplied to the first input terminal 33. When the first clock signal CLK1 is supplied, the fourth, fifth, and eighth transistors M4, M5, and M8 are turned on.

When the fifth transistor M5 is turned on, a high voltage is supplied to the first node N1. When the high voltage is supplied to the first node N1, the first and third transistors M1 and M3 are turned off.

When the fourth transistor M4 is turned on, the voltage of the second power source VSS is supplied to the second node N2. When the voltage of the second power source VSS is supplied to the second node N2, the second transistor M2 is turned on. When the second transistor M2 is turned on, the voltage of the second power source VSS is supplied to the first output terminal 37. When the voltage of the second power source VSS is supplied to the first output terminal 37, the sixth transistor M6 is turned on. When the sixth transistor M6 is turned on, the voltage of the first power source VDD is supplied to the second output terminal 38.

When the eighth transistor M8 is turned on, a high voltage is supplied to the third node N3. When the high voltage is supplied to the third node N3, the seventh transistor M7 is turned off. In this instance, the fourth capacitor C4 charges a voltage corresponding to the turned-off of the seventh transistor M7.

After the first clock signal CLK1 is supplied, the second clock signal CLK2 is supplied during the next horizontal period. In this instance, the seventh transistor M7 is set to be in a turned-off state, and hence the second clock signal CLK2 is not supplied to the second output terminal 38. Additionally, the second clock signal CLK2 supplied to the second input terminal 34 is supplied to the second node N2 by the coupling of the third capacitor C3.

Then, the voltage at the second node N2 is decreased to a voltage lower than the voltage of the second power source VSS. In this case, a voltage lower than the second power source VSS may be supplied to the first output terminal 37. More specifically, when the voltage of the second power source VSS is supplied to the second node N2, the voltages of the gate and second electrodes of the second transistor M2 are set identical (or very close) to each other. In this case, the voltage of the first output terminal 37 is set to a voltage obtained by adding the threshold voltage of the second transistor M2 to the voltage of the second power source VSS.

When the voltage at the second node N2 is decreased to the voltage lower than the voltage of the second power source VSS by the coupling of the third capacitor C3, the voltage of the second power source VSS is outputted to the first output terminal 37, and accordingly, it is possible to ensure the stability of outputs. Since the voltage at the second node N2 is decreased whenever the second clock signal CLK2 is supplied, the voltage at the second node N2 is stably maintained as a low voltage. Accordingly, the voltage of the second power source VSS can be stably outputted to the first output terminal 37.

Meanwhile, the sampling signal SR is supplied to the next stage or the previous stage in synchronization with the second clock signal CLK2 (the second clock signal CLK2 is supplied to the input terminal of each of the next and previous stages). In this case, the next stage stably outputs an emission control signal using the sampling signal SR.

Additionally, although it has been illustrated in FIG. 4 that one sampling signal is generated corresponding to the start signal FLM, the present invention is not limited thereto. For example, when the start signal FLM overlaps two first clock signals CLK1 (that is, start signal FLM is wider, such that it overlaps two low pulses of the first clock signal CLK1), two sampling signals are supplied to the current and next stages. That is, in embodiments of the present invention, the width of the start signal FLM is controlled, so that the width of the emission control signal can be freely adjusted.

Figure 5:
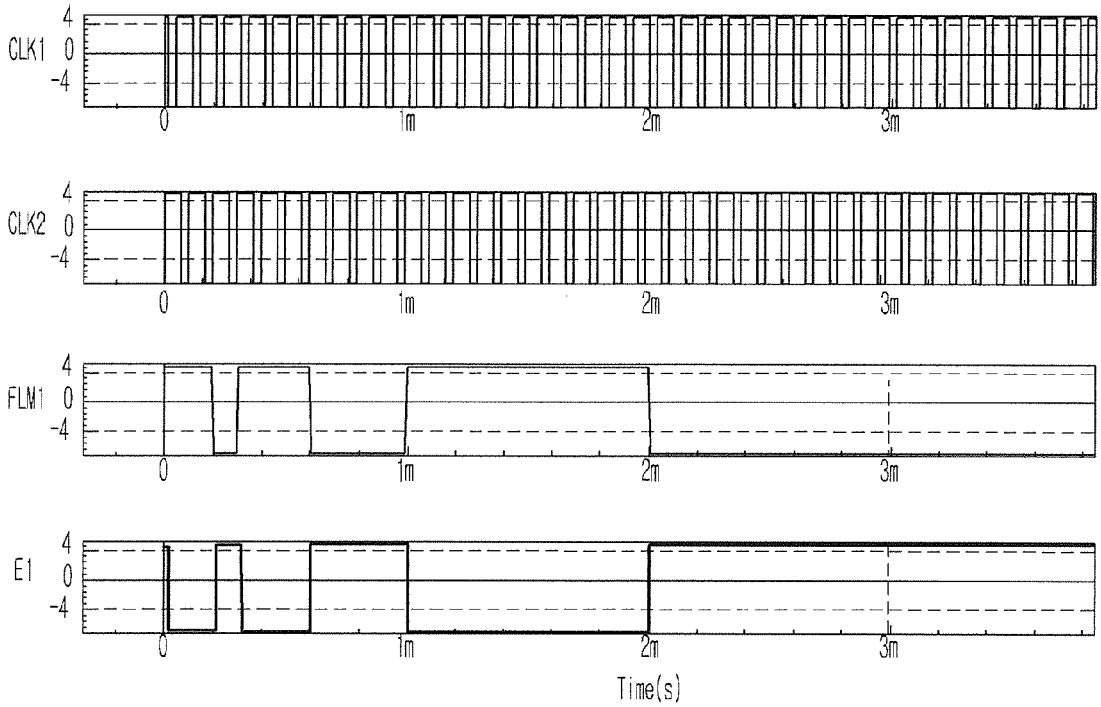
FIG. 5 is a simulation result showing an emission control signal corresponding to a start signal of the stage circuit shown in FIG. 3.

FIG. 5 is a simulation result showing an emission control signal corresponding to a start signal of the stage circuit shown in FIG. 3.

Referring to FIG. 5, when the width of the start signal FLM (e.g., identified as FLM1 in FIG. 5) is variously set while alternately supplying the first and second clock signals CLK1 and CLK2, the emission control signal (e.g., identified as E1 in FIG. 5) supplied to the first output terminal 37 (i.e., the emission control line E1) is changed corresponding to the width of the start signal FLM. That is, in the stage circuit of the embodiment of FIG. 3, the width of the emission control signal is stably changed corresponding to the width of the start signal FLM.

Figure 6:
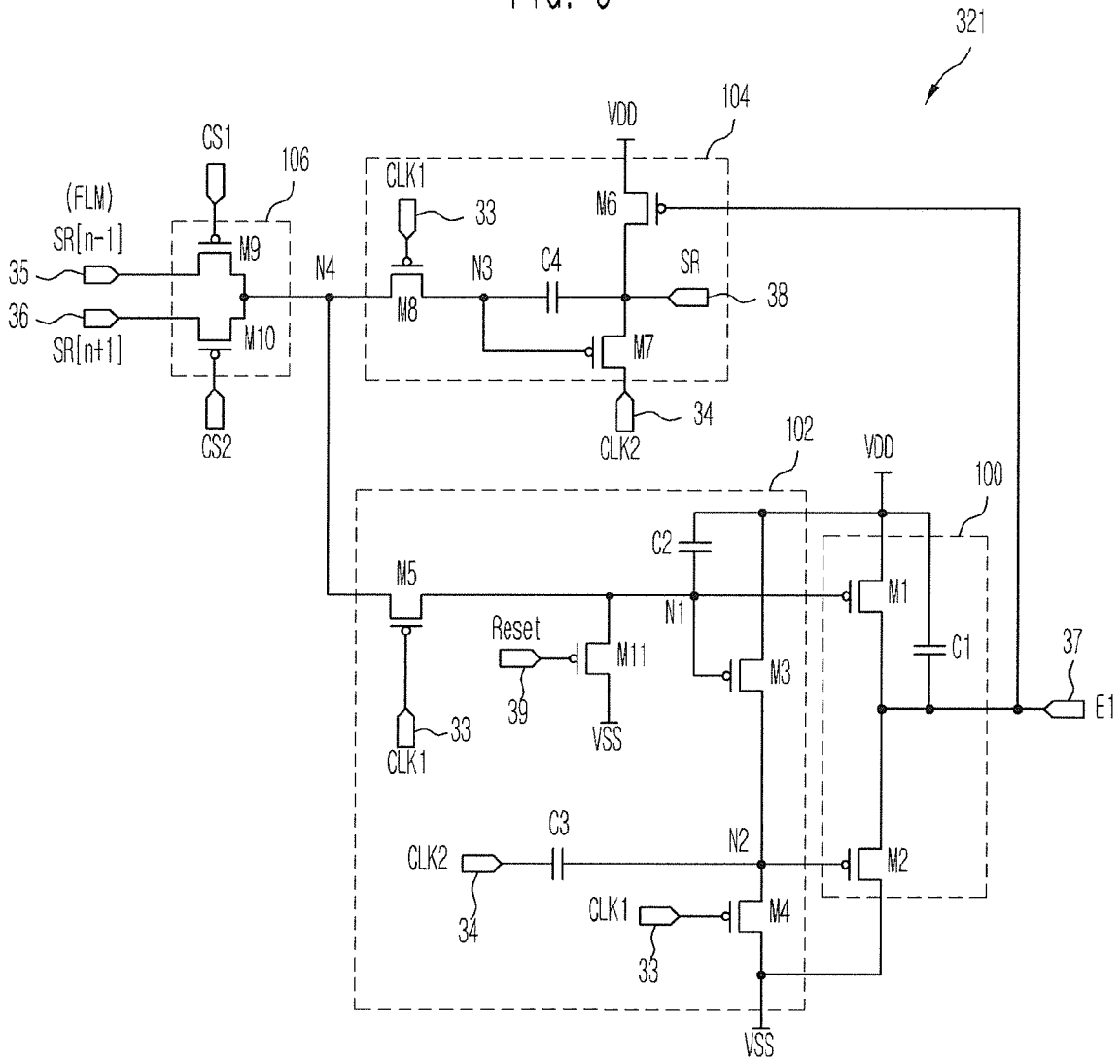
FIG. 6 is a circuit diagram showing a second embodiment of the stage circuit shown in FIG. 2.

FIG. 6 is a circuit diagram showing a second embodiment of the stage shown in FIG. 2. In description of FIG. 6, components identical to those of FIG. 3 are designated by like reference numerals, and their detailed descriptions will not be repeated.

Referring to FIG. 6, the stage 321 further includes an eleventh transistor M11 coupled between the first node N1 and the second power source VSS. A gate electrode of the eleventh transistor M11 is coupled to a fifth input terminal 39. The fifth input terminal 39 receives a reset signal Reset supplied from the timing controller 60.

The operating process of the stage 321 in FIG. 6 will be described. With the turning on and/or off of the power, the timing controller 60 supplies the reset signal Reset to the fifth input terminal 39. When the reset signal Reset is supplied to the fifth input terminal 39, the eleventh transistor M11 is turned on. When the eleventh transistor M11 is turned on, the voltage of the second power source VSS is supplied to the first node N1.

When the voltage of the second power source VSS is supplied to the first node N1, the first and third transistors M1 and M3 are turned on. When the first transistor M1 is turned on, the voltage of the first power source VDD is outputted to the first output terminal 37. When the third transistor M3 is turned on, the voltage of the first power source VDD is supplied to the second node N2. When the voltage of the first power source VDD is supplied to the second node N2, the second transistor M2 is turned off, and accordingly, the voltage of the first power source VDD can be stably supplied to the first output terminal 37.

As described above, the eleventh transistor M11 is turned on with the turning on and/or off of the power. Then, the pixels 50 are forcibly set to be in an off state with the turning on and/or off of the power. Accordingly, it is possible to prevent or reduce the flow of overcurrent.

Figure 7:
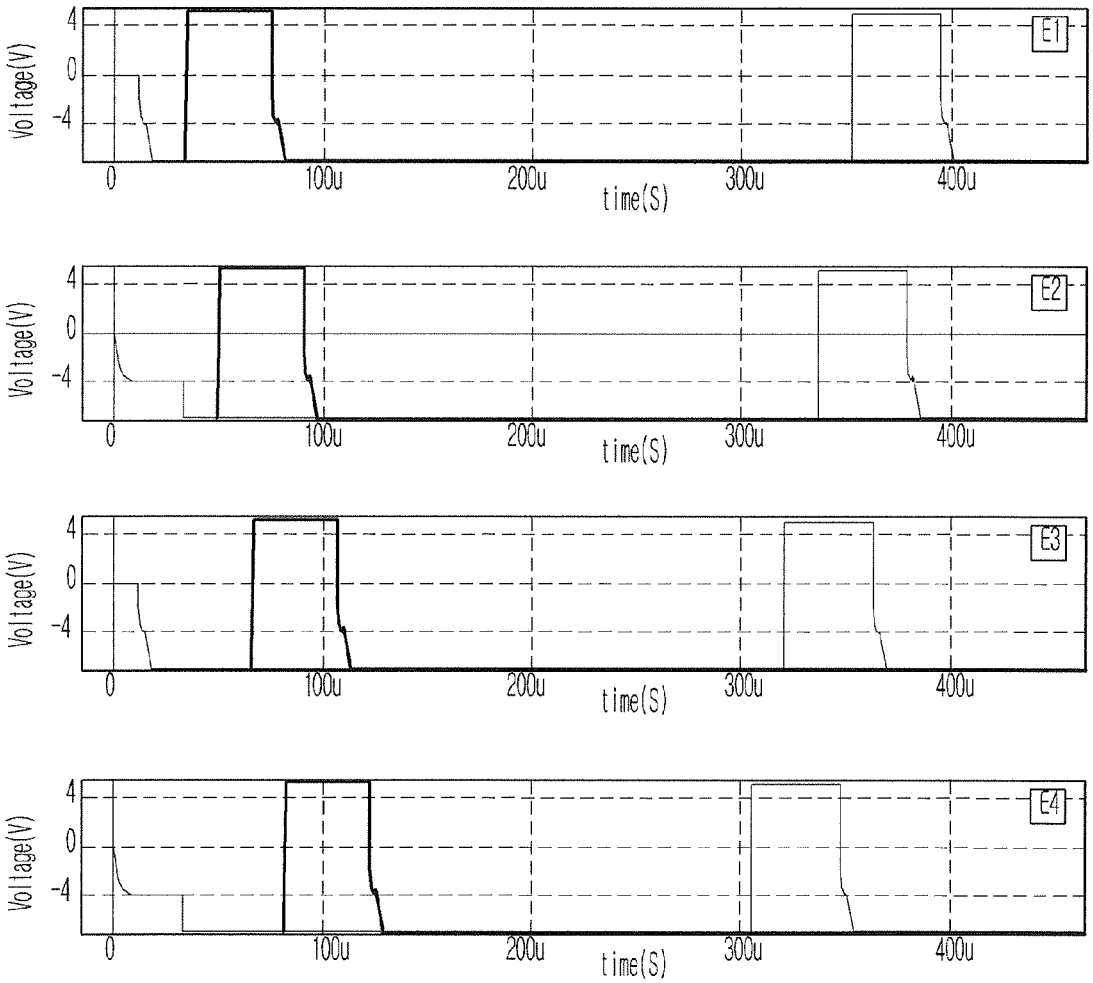
FIG. 7 is a simulation result showing bidirectional driving of the stage circuit shown in FIG. 3.

FIG. 7 is a simulation result showing bidirectional driving of the stage circuit shown in FIG. 3.

Referring to FIG. 7, the emission control signal is sequentially supplied in the first and second directions through the emission control lines E1 to E4. The first direction (forward direction) can be seen in the bold signals showing up in the left hand portions of the signals E1 to E4, while the second direction (backward direction) can be seen in the non-bold signals showing up in the right hand portions (corresponding to a later time than those of the first direction) of the signals E1 to E4. That is, in embodiments of the present invention, the emission control signal can be stably supplied in the first and second directions using the stages 321 to 32*n*. Accordingly, embodiments of the present invention can be applied to various driving methods.

Figure 8:
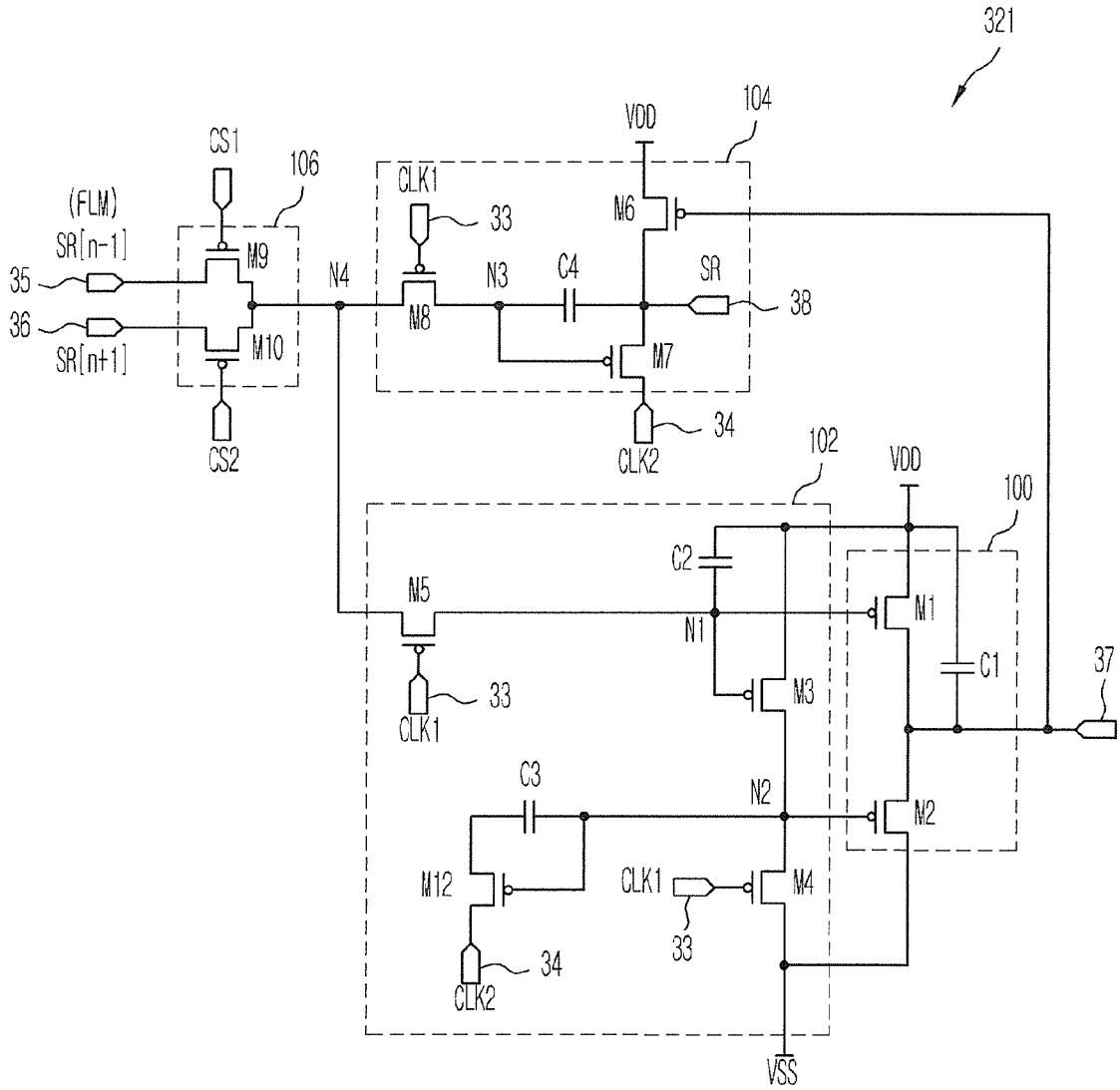
FIG. 8 is a circuit diagram showing a third embodiment of the stage circuit shown in FIG. 2.

FIG. 8 is a circuit diagram showing a third embodiment of the stage shown in FIG. 2. In description of FIG. 8, components identical to those of FIG. 3 are designated by like reference numerals, and their detailed descriptions will not be repeated.

Referring to FIG. 8, the stage 321 further includes a twelfth transistor M12 coupled between the third capacitor C3 and the second input terminal 34. A gate electrode of the twelfth transistor M12 is coupled to the second node N2. When a low voltage (e.g., the voltage of the second power source VSS, the sampling signal SR, or the start signal FLM) is supplied to the second node N2, the twelfth transistor M12 is turned on. When a high voltage (e.g., the voltage of the first power source VDD) is supplied to the second node N2, the twelfth transistor M12 is turned off.

That is, when the high voltage is supplied to the second node N2, the twelfth transistor M12 is turned off to prevent (or reduce the amount of) the voltage at the second node N2 from being changed, corresponding to the second clock signal CLK2. When the low voltage is supplied to the second node N2, the twelfth transistor M12 is turned on to lower the voltage at the second node N2, corresponding to the second clock signal CLK2. The operation of the stage circuit in FIG. 8, except for that of the twelfth transistor M12, is similar to that of FIG. 3, and therefore, its detailed description will not be repeated.

Figure 9:
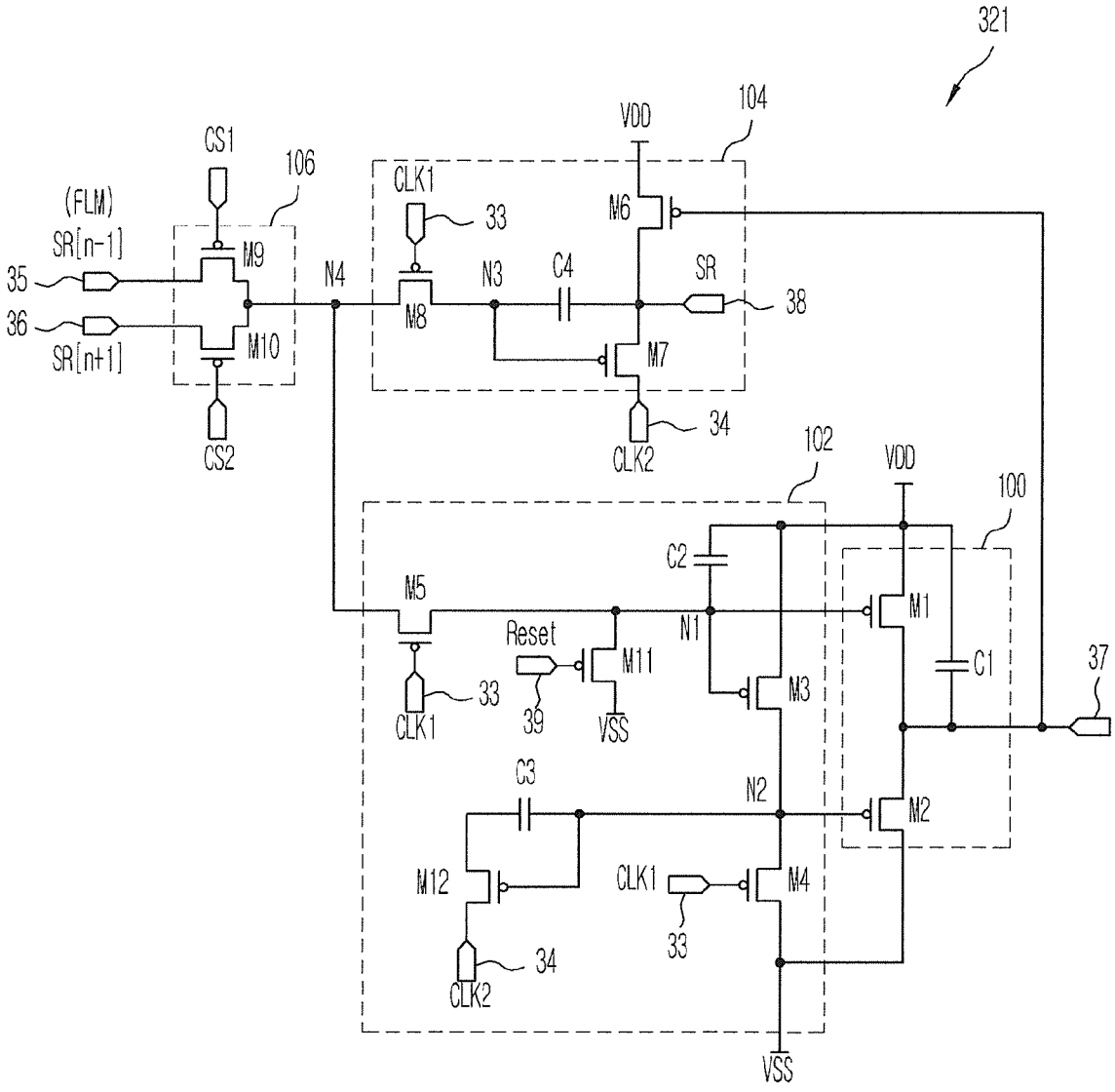
FIG. 9 is a circuit diagram showing a fourth embodiment of the stage circuit shown in FIG. 2.

Meanwhile, in other embodiments of the present invention, the eleventh transistor M11 shown in FIG. 6 may be additionally included in the stage circuit shown in FIG. 8, as shown in FIG. 9. In this case, the eleventh transistor M11 is set to be in a turned-on state with the turning on and/or off of the power, so that it is possible to prevent or reduce overcurrent from flowing in a panel.

Figure 10:
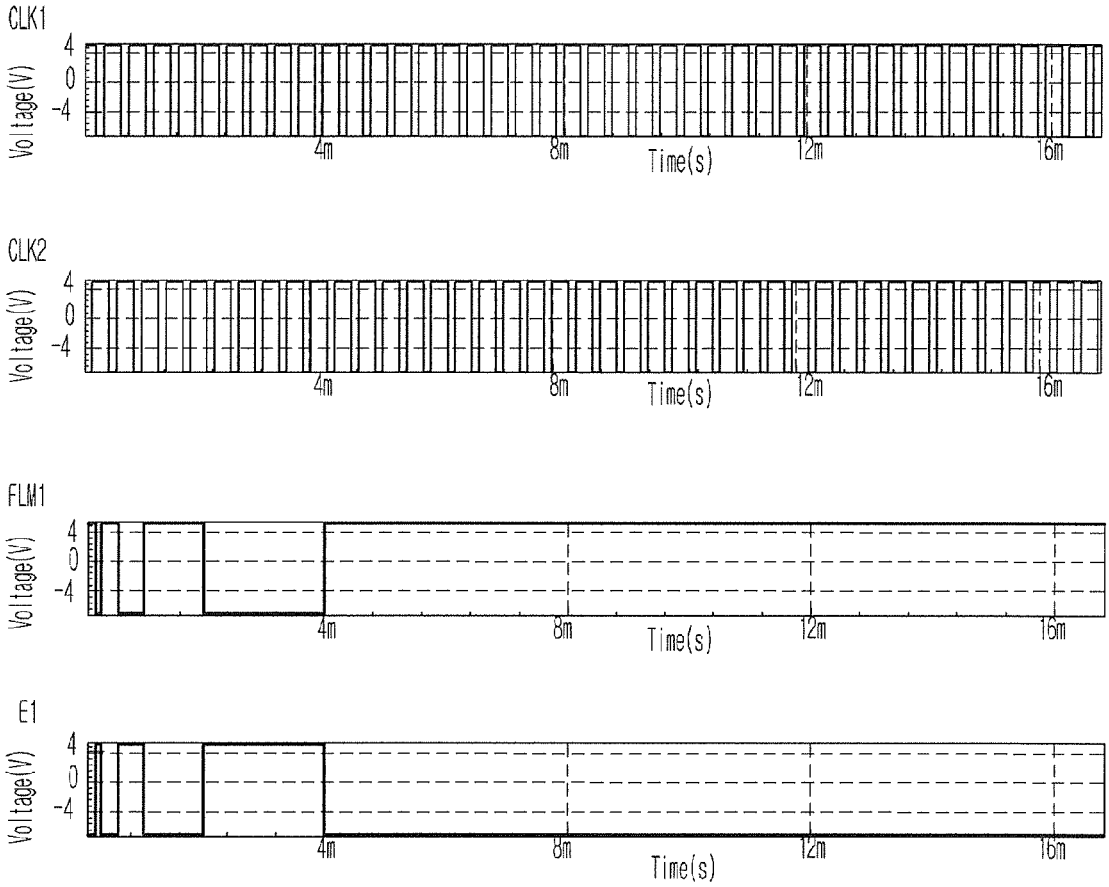
FIG. 10 is a simulation result of the stage circuit shown in FIG. 8.

FIG. 10 is a simulation result of the stage circuit shown in FIG. 8.

Referring to FIG. 10, when the width of the start signal FLM (e.g., identified as FLM1 in FIG. 10) is variously set while alternately supplying the first and second clock signals CLK1 and CLK2, the emission control signal (e.g., identified as E1 in FIG. 10) supplied to the first output terminal 37 (i.e., the emission control line E1) is changed corresponding to the width of the start signal FLM. That is, in the stage circuit of embodiments of the present invention, the width of the emission control signal is stably changed corresponding to the width of the start signal FLM.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A stage circuit for a current stage, comprising:

an output unit comprising fourth and fifth transistors for outputting voltages of first and second power sources, respectively, to a first output terminal according to voltages at first and second nodes, respectively, the first and second node voltages being voltages of gate electrodes of the fourth and fifth transistors, respectively;

a bidirectional driver for receiving sampling signals of previous and next stages;

a first driver coupled to the bidirectional driver and configured to control the voltages at the first and second nodes, corresponding to first and second clock signals; and a second driver coupled to the bidirectional driver and configured to output a sampling signal of the current stage corresponding to the first and second clock signals, wherein the first driver comprises:

a first transistor coupled between the first power source and the second node, and comprising a gate electrode coupled to the first node;

a second transistor coupled between the second node and the second power source, and comprising a gate electrode coupled to a first input terminal;

a third transistor coupled between the bidirectional driver and the first node, and comprising a gate electrode coupled to the first input terminal; and a first capacitor coupled between the second node and a second input terminal.

2. The stage circuit according to claim 1, wherein the first driver further comprises a second capacitor coupled between the first node and the first power source.

3. The stage circuit according to claim 1, wherein the first input terminal is configured to receive the first clock signal and the second input terminal is configured to receive the second clock signal.

4. The stage circuit according to claim 1, wherein the first and second clock signals are configured to be supplied during different horizontal periods from each other.

5. The stage circuit according to claim 1, wherein the first power source is set to have a higher voltage than the second power source.

6. The stage circuit according to claim 1, wherein the fourth transistor is coupled between the first power source and the first output terminal, the gate electrode of the fourth transistor being coupled to the first node, the fifth transistor is coupled between the first output terminal and the second power source, the gate electrode of the fifth transistor being coupled to the second node, and the output unit further comprises a third capacitor coupled between the first power source and the first output terminal.

7. The stage circuit according to claim 1, wherein the second driver comprises:

a sixth transistor coupled between the first power source and a second output terminal, and comprising a gate electrode coupled to the first output terminal;

a seventh transistor coupled between the second output terminal and the second input terminal, and comprising a gate electrode coupled to a third node;

an eighth transistor coupled between the third node and the bidirectional driver, and comprising a gate electrode coupled to the first input terminal; and a fourth capacitor coupled between the third node and the second output terminal.

8. The stage circuit according to claim 1, wherein the bidirectional driver comprises:

a ninth transistor coupled between the previous stage and a fourth node that is a common terminal of the first and second drivers, and comprising a gate electrode configured to receive a first control signal; and a tenth transistor coupled between the next stage and the fourth node, and comprising a gate electrode configured to receive a second control signal.

9. The stage circuit according to claim 8, wherein the first and second control signals are configured to be supplied without overlapping each other.

10. The stage circuit according to claim 1, further comprising an eleventh transistor coupled between the first node and the second power source, and comprising a gate electrode configured to receive a reset signal.

11. The stage circuit according to claim 10, wherein the reset signal is configured to be supplied at least once when power is turned on or off.

12. The stage circuit according to claim 1, further comprising a twelfth transistor coupled between the first capacitor and the second input terminal, and comprising a gate electrode coupled to the second node.

13. An emission driver for supplying an emission control signal to emission control lines to control emission of pixels, the emission driver comprising the stage circuit according to claim 1, coupled to one of the emission control lines.

14. A stage circuit for a current stage, comprising:

an output unit for outputting a voltage of a first or second power source to a first output terminal, corresponding to a voltage at a first or second node;

a bidirectional driver for receiving sampling signals of previous and next stages;

a first driver coupled to the bidirectional driver and configured to control the voltages at the first and second nodes, corresponding to first and second clock signals; and a second driver coupled to the bidirectional driver and configured to output a sampling signal of the current stage corresponding to the first and second clock signals, wherein the first driver comprises:

a first transistor coupled between the first power source and the second node, and comprising a gate electrode coupled to the first node;

a second transistor coupled between the second node and the second power source, and comprising a gate electrode coupled to a first input terminal;

a third transistor coupled between the bidirectional driver and the first node, and comprising a gate electrode coupled to the first input terminal; and a first capacitor coupled between the second node and a second input terminal, and wherein the first transistor has a lower resistance than the second transistor.

15. An emission driver for supplying an emission control signal to emission control lines via corresponding stages to control emission of pixels, the emission driver comprising a stage circuit for each of the stages and coupled to a respective one of the emission control lines, wherein the stage circuit for a current one of the stages comprises:

an output unit comprising fourth and fifth transistors for outputting voltages of first and second power sources, respectively, to a first output terminal coupled to the respective one of the emission control lines according to voltages at first and second nodes, respectively, the first and second node voltages being voltages of gate electrodes of the fourth and fifth transistors, respectively;

a bidirectional driver for receiving sampling signals of previous and next ones of the stages;

a first driver coupled to the bidirectional driver and configured to control the voltages at the first and second nodes, corresponding to first and second clock signals; and a second driver coupled to the bidirectional driver and configured to output a sampling signal of the current one of the stages corresponding to the first and second clock signals, wherein the first driver comprises:

a first transistor coupled between the first power source and the second node, and comprising a gate electrode coupled to the first node;

a second transistor coupled between the second node and the second power source, and comprising a gate electrode coupled to a first input terminal;

a third transistor coupled between the bidirectional driver and the first node, and comprising a gate electrode coupled to the first input terminal; and a first capacitor coupled between the second node and a second input terminal.

16. The emission driver according to claim 15, wherein:

the first and second input terminals of a k-th (k is an odd number) one of the stages are configured to receive the first and second clock signals, respectively; and the first and second input terminals of a (k+1)-th one of the stages are configured to receive the second and first clock signals, respectively.

17. The emission driver according to claim 15, wherein the fourth transistor is coupled between the first power source and the first output terminal, the gate electrode of the fourth transistor being coupled to the first node, the fifth transistor is coupled between the first output terminal and the second power source, the gate electrode of the fifth transistor being coupled to the second node, and the output unit further comprises a second capacitor coupled between the first power source and the first output terminal.

18. The emission driver according to claim 15, wherein the second driver comprises:

a sixth transistor coupled between the first power source and a second output terminal, and comprising a gate electrode coupled to the first output terminal;

a seventh transistor coupled between the second output terminal and the second input terminal, and comprising a gate electrode coupled to a third node;

an eighth transistor coupled between the third node and the bidirectional driver, and comprising a gate electrode coupled to the first input terminal; and a third capacitor coupled between the third node and the second output terminal.

19. The emission driver according to claim 15, further comprising an eleventh transistor coupled between the first node and the second power source, and comprising a gate electrode configured to receive a reset signal.

20. The emission driver according to claim 19, wherein the reset signal is configured to be supplied at least once when power is turned on or off.

21. The emission driver according to claim 15, further comprising a twelfth transistor coupled between the first capacitor and the second input terminal, and comprising a gate electrode coupled to the second node.

* * * * *